United States Patent [19]

St. Amand et al.

[11] 4,015,401

[45] Apr. 5, 1977

[54] METHOD OF FORMING CLOSURE SYSTEM FOR MEDICAL LIQUID CONTAINER

[75] Inventors: Elmer F. St. Amand, North Hollywood; Thomas R. Thornbury, La Crescenta, both of Calif.

[73] Assignee: American Hospital Supply Corporation, Evanston, Ill.

[22] Filed: Apr. 17, 1975

[21] Appl. No.: 568,989

Related U.S. Application Data

[62] Division of Ser. No. 338,684, Mar. 7, 1973, Pat. No. 3,923,062.

[52] U.S. Cl. ..... 53/29; 53/37; 53/41; 53/42

[51] Int. Cl.[2] ..... B65B 53/06; B65B 43/00; B65B 7/28; B67B 3/20

[58] Field of Search ..... 53/29, 30 S, 37, 41, 53/141, 42, 184 S, 331.5, 289, 290, 39, 281, 329; 249/59, 109; 264/230, DIG. 71; 156/85, 86, 69; 215/246, 232

[56] References Cited

UNITED STATES PATENTS

| | | | |
|---|---|---|---|
| 825,116 | 7/1906 | Engels | 53/42 X |
| 2,378,586 | 6/1945 | Schultz | 249/109 X |
| 2,608,334 | 8/1952 | Knocke | 53/42 UX |
| 2,620,939 | 12/1952 | Weisgerber | 53/39 X |
| 2,657,431 | 11/1953 | Slaughter | 53/29 UX |
| 2,885,105 | 5/1959 | Heyl et al. | 53/42 UX |
| 2,937,481 | 5/1960 | Palmer | 53/42 X |
| 3,388,431 | 6/1968 | Aoki | 249/59 X |
| 3,504,817 | 4/1970 | Heider | 53/42 X |
| 3,773,205 | 11/1973 | Keeler et al. | 53/39 X |

FOREIGN PATENTS OR APPLICATIONS

| | | | |
|---|---|---|---|
| 1,384,370 | 2/1975 | United Kingdom | 215/246 |

*Primary Examiner*—Travis S. McGehee
*Assistant Examiner*—Horace M. Culver
*Attorney, Agent, or Firm*—Y. Judd Azulay; Larry Barger

[57] ABSTRACT

A medical liquid bottle having a threaded neck of one thermoplastic material is blow-molded at pressures of 50 to 150 psi (3.52 to 10.1 kg/cm$^2$) so there is a low amount of internal stress in the neck. A cap of a different thermoplastic material is injection molded at pressures of 5,000 to 20,000 psi (352 to 1,410 kg/cm$^2$) producing a very high internal stress in this cap. After liquid has been placed in the bottle and the cap assembled to the neck, the bottle with the combined cap and neck are stress relieved by subjecting to steam sterilization at 240° F. to 260° F. (116° C. to 127° C.). This causes the cap to shrink more than the neck and to form a bacteria-tight thermoplastic-to-thermoplastic hermetic seal. Despite this very tight hermetic seal the closure is openable with an unexpectedly low unscrewing torque of 10 to 30 inch-pounds (11.5 to 34.5 centimeter-kilograms) manually applied by a nurse or physician.

4 Claims, 6 Drawing Figures

METHOD OF FORMING CLOSURE SYSTEM FOR MEDICAL LIQUID CONTAINER

This is a division, of application Ser. No. 338,684 now U.S. Pat. No. 3,923,062. filed Mar. 7, 1973

BACKGROUND

Sterile medical liquids are frequently supplied by manufacturers to hospitals in sterilized bottles. One type of bottle used for the medical liquids is termed a "pouring" container. This container has a wide mouth of approximately 1 inch (2.54 cm) diameter. Thus a physician can quickly pour the sterile liquid into a surgical wound for a flushing action.

An extremely critical area of these "pouring" containers is the closure system. The closure must reliably maintain the sterile nature of the liquid in the bottle and also be easy to open.

In the past, pouring containers included glass type bottles with double closures. The double closure had an inner metal screw cap with a resilient liner or gasket engaging the glass bottle. An outer closure secured over the inner screw cap formed an additional sterility barrier. One of the problems with such a closure was that the gasket of the inner screw cap would not always compress to the same extent. This caused some closures to be very difficult to manually unscrew. One can readily appreciate such a problem by considering the difficulty of opening some glass food jars with metal screw caps and gaskets.

SUMMARY OF THE INVENTION

This invention overcomes the problems mentioned above by providing a unique structure and process that eliminates the need for a separate resilient sealing gasket. In this invention a bottle has an integrally formed externally threaded thermoplastic neck. Both the bottle and neck are formed of a thermoplastic material blow-molded at pressures of 50 to 150 psi (3.52 to 10.1 kg/cm$^2$) to cause low internal stresses to be molded in the neck. An internally threaded screw cap of a different thermoplastic material is injection molded at pressures of 5,000 to 20,000 psi (352 to 1,410 kg/cm$^2$) to create very high internal stresses in the screw cap. After liquid contents have been placed in the bottle, and the screw cap threaded onto the neck, this assembly is heated preferably by steam sterilization to 240° F. to 260° F. (116° C. to 127° C.). This causes a substantially greater amount of stress relief in the cap than in the neck. When this happens the rigid cap shrinks more than the rigid neck to provide a thermoplastic-to-thermoplastic bacteria-tight hermetic seal of increased tightness between the cap and neck.

It would be expected that such a seal would be too tight to open manually. Shrink film sleeves previously used to secure corks or plugs in wine bottles have gripped so tightly that they had to be cut apart with a knife. In the present invention it has unexpectedly been found that the very tight hermetic seal can be opened with approximately 20 inch-pounds (23 centimeter-kilograms) of unscrewing torque. A nurse or physician can readily apply this amount of torque manually.

THE DRAWINGS

DETAILED DESCRIPTION

Figure 1:
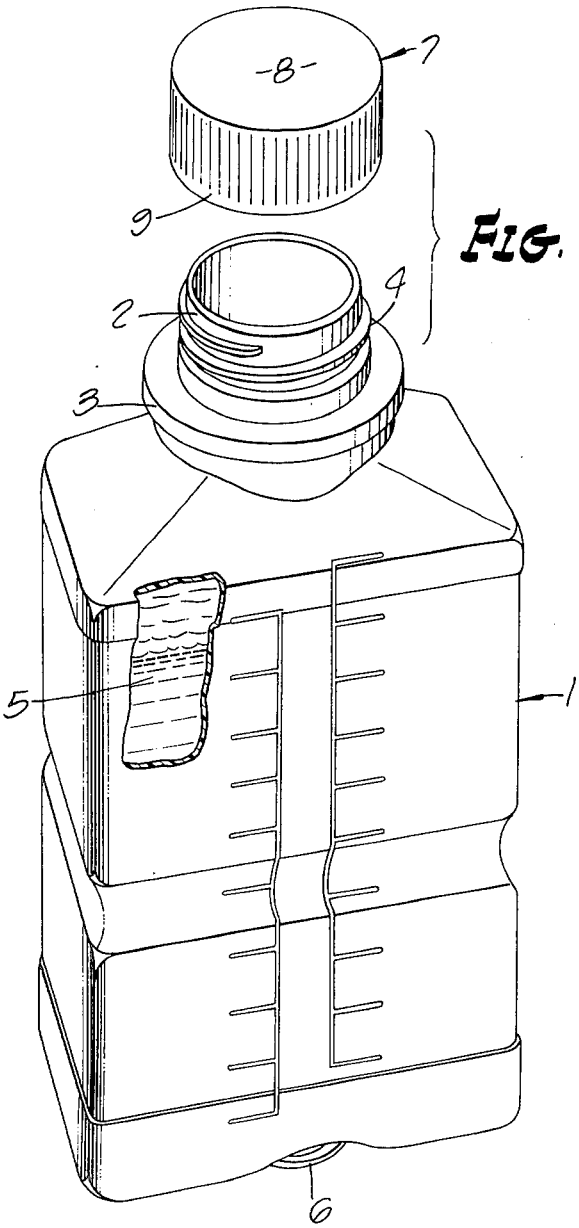
FIG. 1 is an exploded partially cut away view of the inner screw cap and bottle neck combination.

In FIG. 1 a thermoplastic bottle 1 is shown having an integral dispensing neck 2. This neck has an external flange 3 and external threads 4. The container is partially filled with sterile medical liquid 5. At a base of the container is a flexible hanging tab 6 secured in a recess at the bottom of the bottle. This hanging tab 6 can be snapped out of the recess for suspending the bottle neck downwardly when dispensing the liquid through an irrigation set or the like.

FIG. 1 shows the bottle neck 2 that is integrally formed with the bottle. Both the bottle neck and bottle are blow-molded of a propylene-ethylene copolymer. This blow-molding takes place at pressures of 50 to 150 psi (3.52 to 10.1 kg/cm$^2$) to create low internal stresses in the thermoplastic bottle neck.

Shown directly above the bottle neck in FIG. 1 is an inner screw cap closure 7, with a top wall 8 and a depending skirt 9. This cap is formed of a second thermoplastic material that is different from the first thermoplastic material of the threaded neck. Cap 7 is injection molded at pressures 5,000 to 20,000 psi (352 to 1,410 kg/cm$^2$) to create a high amount of internal stress in the cap 7.

As mentioned above the thermoplastic material of the bottle and neck is different from the thermoplastic material of the cap. For example, the bottle neck has been made of a propylene-ethylene copolymer and when cooled to room temperature after blow-molding, this copolymer shrinks at a rate of 0.009 to 0.020 inch/-linear inch (0.009 to 0.020 centimeter/linear centimeter). The cap 7 is of a high density polyethylene that shrinks when cooled to room temperature after molding at a rate of 0.020 to 0.050inch/linear inch (0.020 to 0.050 centimeter/linear centimeter). After these two materials shrink from the mold, they still contain internal stresses. These post molding stresses are substantially greater in the cap than in the bottle neck. The different amount of stresses can readily be seen under polarized light.

There are many conditions that contribute to molded in stresses in thermoplastic materials. These can be mixing times, molding temperatures, cooling times, etc. However one of the main reasons for molded in internal stresses is the pressure at which the molten plastic is forced into a mold. In the blow-molded bottle and neck the pressure is very low, such as 50 to 150 psi (3.52 to 10.1 kg/cm$^2$). This is believed to result in the low amount of internal stresses in the thermoplastic neck. The cap is injection molded at very high pressures of from 5,000 to 20,000 psi (352 to 1,410 kg/cm$^2$). This is believed to be the reason for the large amount of molded in internal stresses. Both the bottle neck and cap are molded at approximately 400° F. (205° C.).

Normally the molded in stresses are undesirable and much effort is made to eliminate them. However, in this invention these undesirable stresses have been used to create an improved thermoplastic-to-thermoplastic seal.

These stresses are preferably formed in the cap by injection molding the internally threaded cap of FIG. 1 with a top wall and a longitudinal depending skirt. Preferably the cap is molded with an injection gate located in a central portion of the top wall in an area such as the position of numeral 8 in FIG. 1. This is so the stresses will radiate outwardly from such injection gate and then downwardly longitudinally along the skirt. When such a cap is relieved of its molded in stresses it will tend to shrink along the stress lines and cause the top to diametrically shrink and the skirt to longitudinally shorten.

After cooling to room temperature, liquid is placed in the bottle and the cap assembled to the neck. This unit then is heated such as by steam sterilization to a temperature of 240° to 260° F. (116° to 127° C.) and then subsequently cooled to room temperature. During the heating or sterilization cycle there is substantially more stress in the cap than in the bottle neck that is relieved. This causes the cap to shrink more than the neck and tightly grip the bottle neck.

Figure 2:
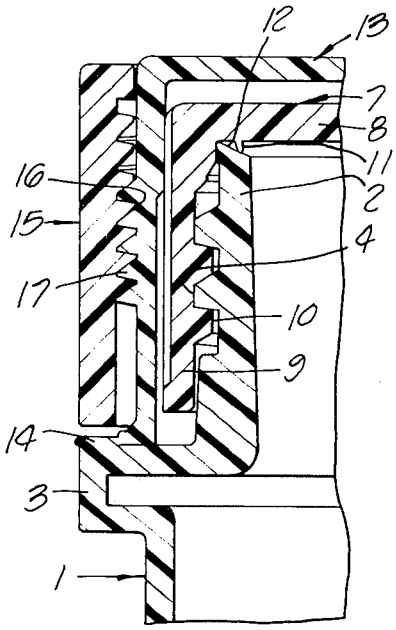
FIG. 2 is an enlarged fragmentary sectional view of the inner and outer closure system prior to opening.

A more detailed illustration of the cap structure is shown in the enlarged sectional view of FIG. 2. As shown in FIG. 2, the inner screw cap closure 7 is threadingly received on the bottle neck 2. Preferably there is an integral compressible thermoplastic rib 11 on the cap that engages a top lip surface 12 of the thermoplastic bottle neck. This helps to make a tight hermetic seal between the screw cap and bottle neck. The outer closure structure includes a cap 13 with a frangible brim 14 that is fused to flange 3. This provides an enclosed encasement for the inner cap 7. A threaded jacking ring 15 has threads 16 that intermesh with external threads 17 of the outer cap 13. This jacking ring fractures the frangible brim to open the outer closure. The jacking ring and its operation is more fully explained in a copending application by Pradip V. Choksi and Roy B. Steidley, filed Mar. 7, 1973 Ser. No. 338,662, now U.S. Pat. No. 3,923,183.

Figure 3:
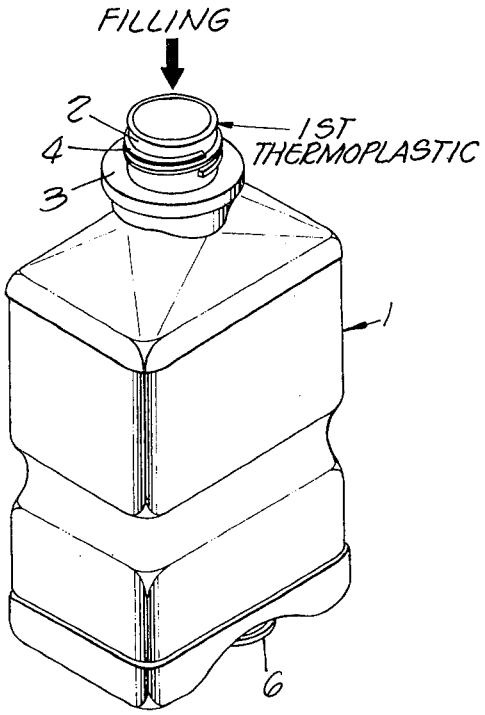
FIGS. 3 through 6 show the bottle and closure system at various steps in the method of forming and opening the improved closure system.
Figure 4:
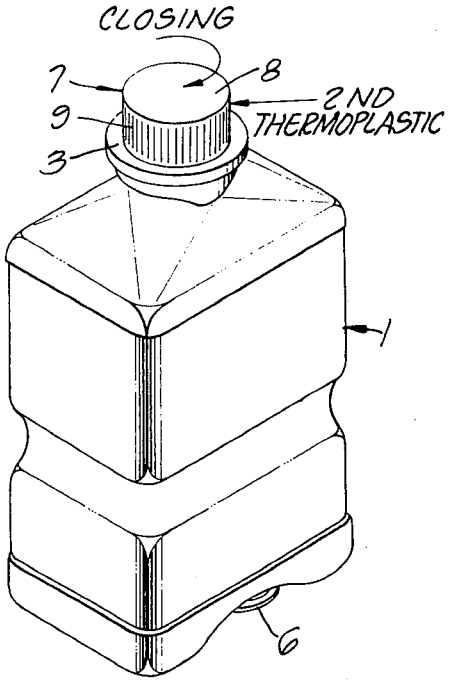
Figure 5:
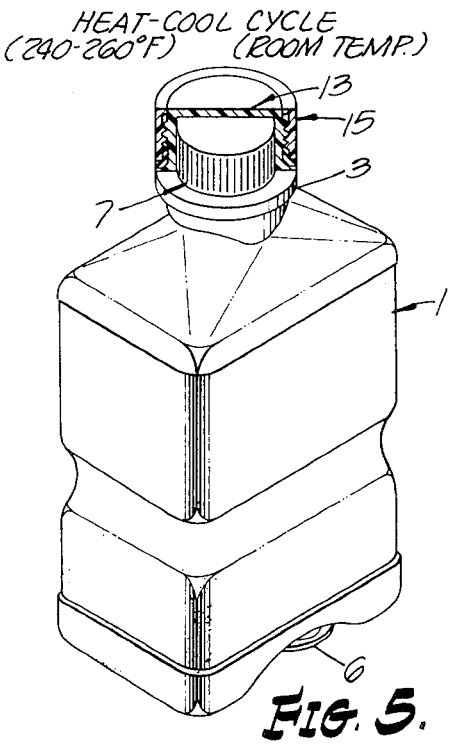
Figure 6:
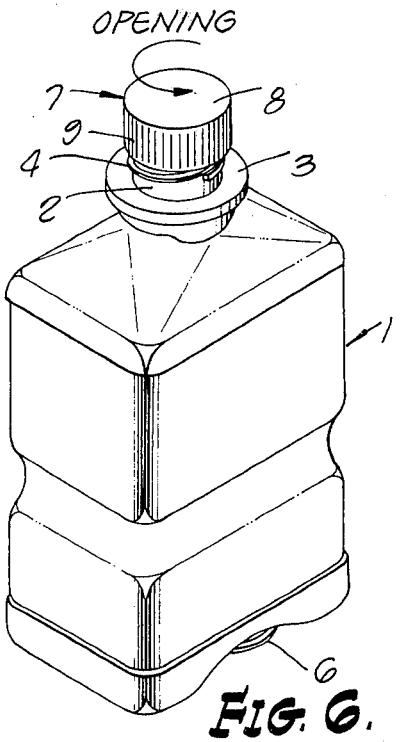

In FIGS. 3 to 6 the sequence of forming and opening the container is shown with the outer closure of FIG. 5 partially cut away for clarity. In FIG. 3 the thermoplastic container of propylene-ethylene copolymer contains a medical liquid, such as 5% dextrose, normal saline, water, etc. Next, in FIG. 4 the thermoplastic inner closure is placed on the threaded neck and screwed down against the bottle neck. The inner closure can be removed at this stage in the process at a torque of 5 inch-pounds (5.7 centimeter-kilograms) to 20 inch-pounds (23 centimeter-kilograms). After the inner closure has been so assembled, the outer closure is sealed to the container as shown in FIG. 5. Then the container with both closures as shown in FIG. 5 is subjected to heat or steam sterilization at 240° F. to 260° F. (116° C. to 127° C.) and maintained at this temperature for approximately 5 minutes. Thereafter, the entire container and closure system and the liquid therein are cooled to room temperature. It has been found that this process creates an improved seal at lip surface 12 between the rigid threaded high density polyethylene screw cap and the rigid threaded neck of the bottle. A propylene-ethylene copolymer marketed by Eastman Chemical Company under the trademark TENITE works very well for the bottle and neck.

A shrink fit closure that improves the sealing characteristics of a thermoplastic-to-thermoplastic hermetic seal (without the use of a separate sliding gasket) would normally be expected to tighten down so much that it would be difficult to remove the inner screw cap. Shrink bands of thermoplastic film used for forming a secondary seal on wine bottles and the like grip the bottle and closure so tightly that the shrink bands have to be cut apart to open the bottle.

It has been unexpectedly found that the disclosed screw cap and bottle neck structure of this invention does not have the removable problem of previous shrink bands, such as used on wine bottles. While the hermetic seal of applicant's invention is improved with the differential shrinkage between the high density polyethylene screw cap and the propylene-ethylene copolymer bottle neck, it simultaneously provides a closure with a relatively constant opening torque of approximately 20 inch-pounds (23 centimeter-kilograms). In actual practice this opening torque does not extend beyond the range of 10 to 30 inch-pounds (11.5 to 34.5 centimeter-kilograms). Therefore the differential shrinkage both: (1) tightens the hermetic seal and (2) adjusts the opening torque of each closure.

The release torque required to remove the caps from the bottles was found to be very consistent after sterilizing, regardless of the initial torque used to seal the cap. Consequently, with a cap that was initially put on with a torque of 5 inch-pounds (5.7 centimeter-kilograms), the removal torque was 20 inch-pounds (23 centimeter-kilograms). A cap that was initially put on with a torque of 20 inch-pounds (23 centimeter-kilograms) also came off at 20 inch-pounds (23 centimeter-kilograms). This relatively constant opening torque is easily applied with a hand twisting motion by the nurse or physician.

In the foregoing specification a specific embodiment has been used to describe this invention. However, it is understood by those skilled in the art that certain modifications can be made to these embodiments without departing from the spirit and scope of the invention.

We claim:

1. A method of forming a bacteria-tight hermetic seal at an outlet of a container for sterile liquids, comprising the steps of:

a. blow molding at a pressure of 50 to 150 psi a first thermoplastic material to form a container with a threaded neck having internal stresses;

b. injection molding at a pressure of 5,000 to 20,000 psi a second thermoplastic material to form a rigid closure with a top wall and a depending skirt having internal threads, with said skirt being thicker than the depth of threads in the skirt, said closure having substantially greater internal stresses than the container neck;

c. placing liquid within the container;

d. assembling the threaded closure onto the threaded neck;

e. subjecting both the top wall and thick threaded skirt of the rigid closure as well as the threaded container neck to a common stress relieving environment to form therebetween a bacteria-tight joint that is openable with a predetermined force of 10 to 30 inch pounds of torque.

2. The method of claim 1, wherein the stress relieving step is carried out by heating to 240° F. to 260° F.

3. The method of claim 2, wherein the heating step is performed by steam sterilization at these temperatures.

4. The method of claim 1, wherein the cap is the outer member and includes a top wall and a longitudinally extending depending skirt, and the cap is formed by injection molding through a gate at a central location of the top wall.

* * * * *